US005305479A

United States Patent [19]

Robinson

[11] Patent Number: 5,305,479

[45] Date of Patent: Apr. 26, 1994

[54] SOFA SLEEPER HAVING SINUOUS SPRING REINFORCED SHOULDER AREA

[75] Inventor: Danny C. Robinson, Carthage, Mo.

[73] Assignee: L&P Property Management Company, Chicago, Ill.

[21] Appl. No.: 64,952

[22] Filed: May 20, 1993

[51] Int. Cl.[5] ..... A47C 17/22; A47C 17/04

[52] U.S. Cl. ..... 5/13; 5/29

[58] Field of Search ..... 5/13, 12.1, 28, 29, 5/30, 31

[56] References Cited

U.S. PATENT DOCUMENTS

| | | | |
|---|---|---|---|
| 3,237,213 | 3/1966 | Birgbauer, Sr. | 5/13 |
| 3,854,153 | 12/1974 | Fadler et al. | 5/13 |
| 4,086,671 | 5/1978 | Lane | 5/13 |
| 4,584,727 | 4/1986 | Reiss et al. | 5/13 |
| 4,752,976 | 6/1988 | Fanning | 5/13 |

FOREIGN PATENT DOCUMENTS

| | | | |
|---|---|---|---|
| 575721 | 5/1959 | Canada | 5/29 |
| 1654329 | 3/1971 | Fed. Rep. of Germany | 5/13 |
| 835166 | 5/1960 | United Kingdom | 5/29 |

*Primary Examiner*—Alexander Grosz

*Attorney, Agent, or Firm*—Wood, Herron & Evans

[57] ABSTRACT

A sofa sleeper comprises a stationary wooden sofa frame and a foldable sofa bed assembly mounted to the frame which is adapted to move between a fully folded or retracted position within the frame to provide a seat when used as a sofa and an extended unfolded position when used as a bed. The foldable sofa bed assembly includes pivotally interconnected head, body, intermediate and foot frame sections each including a pair of opposed side rails to which a wire fabric or plastic sheeting material is attached. The body frame section includes a pair of opposed cross tie members which extend between the side rails and are adapted to support a plurality of transversely spaced, longitudinal extending sinuous wire springs. Preferably, a rigidity bar extends between the cross tie members to maintain the cross tie spacing. The body frame section including the cross tie members and the longitudinally extending sinuous wire springs are located immediately beneath the mattress supporting fabric or plastic sheeting material so as to provide an improved cushion foundation when the sofa sleeper is used as a seating surface and an improved mattress foundation when the sofa sleeper is used as a bed.

6 Claims, 3 Drawing Sheets

SOFA SLEEPER HAVING SINUOUS SPRING REINFORCED SHOULDER AREA

This invention relates to a sofa sleeper of the type which includes a foldable bed which may be collapsed and hidden in the bottom of the sofa when the unit is used as a seating surface.

BACKGROUND OF THE INVENTION

Foldable sofa sleepers having pivotally interconnected head, body, intermediate and foot sections movable between a fully folded or retracted position within the sofa frame for use as a seat, and an extended, unfolded position for use as a bed, are known in the art. Prior foldable sofa sleepers are typically characterized by a relatively poor sleeping surface and a less than desirable seating surface. Most prior sofa sleepers represent a compromise between a good bed and a good sofa in that no matter how well constructed, they are not as good for sleeping as most beds and not as good for seating as most sofas. Poor sleeping quality can be attributed to the provision of a poor foundation beneath the mattress, and poor seating quality stems from the same problem, a lack of firm foundation beneath the seat cushions.

Most sofa sleepers employ a wire fabric material or a sheet of woven polypropylene or other plastic materials extending between the side rails of the head, body, intermediate and foot sections of the sofa bed fixture for support of a foldable mattress. Wire fabric alone or plastic sheeting alone has proven to be unsatisfactory in providing sufficient support for both the mattress and seat cushions of the sofa sleeper. The mattress support sags excessively when the frame is unfolded for use as a bed and when providing a seat in the folded position.

In an effort to provide a better foundation beneath the mattress and seat cushions, attempts have been made to reinforce the wire fabric or plastic sheeting in all of the frame sections and particularly the body frame section of the sofa bed fixture where most of the weight is applied in using the sofa sleeper either as a bed or seat. Supports have been positioned beneath the fabric or plastic sheeting material in the area of the body frame section to help prevent sagging. While known supports for the fabric or plastic sheeting have provided improved foundation support for the mattress and seat cushions, such supports have failed to provide the user with the desired feel of a mattress supported by box springs when the sofa sleeper is used as a bed.

SUMMARY OF THE INVENTION

The sofa sleeper of this invention comprises a foldable sofa bed assembly adapted to be mounted upon a stationary wooden sofa frame. The foldable sofa bed assembly conventionally includes pivotally interconnected head, body, intermediate and foot frame sections, each including a pair of opposed side rails to which a section of the fabric or plastic sheeting material is attached. According to the practice of this invention, the body frame section includes a mattress supporting panel extending between the opposed side rails of the body section. This panel comprises a pair of opposed cross members or cross ties which extend between and are mounted to the side rails of the body frame section. Extending between these cross ties are a plurality of transversely spaced, longitudinally extending sinuous wire springs connected at their opposite ends to the cross ties of the mattress supporting panel. This panel functions to resiliently support the mattress and to prevent sagging of the mattress supporting fabric or plastic sheeting material in the body frame section of the sofa bed assembly, which receives most of the weight when the sofa sleeper is used as a seating sofa or a bed. The longitudinally extending sinuous wire springs of the panels provide a firm but resilient foundation beneath the fabric or plastic sheeting material to evenly support the mattress with the sofa sleeper extended to form a bed, or the seat cushions with the sofa sleeper in a retracted sofa seating position.

DESCRIPTION OF THE DRAWINGS

The structure, operation and advantages of this invention will become more readily apparent from the following description of the drawings in which.

DETAILED DESCRIPTION OF THE INVENTION

Figure 1:
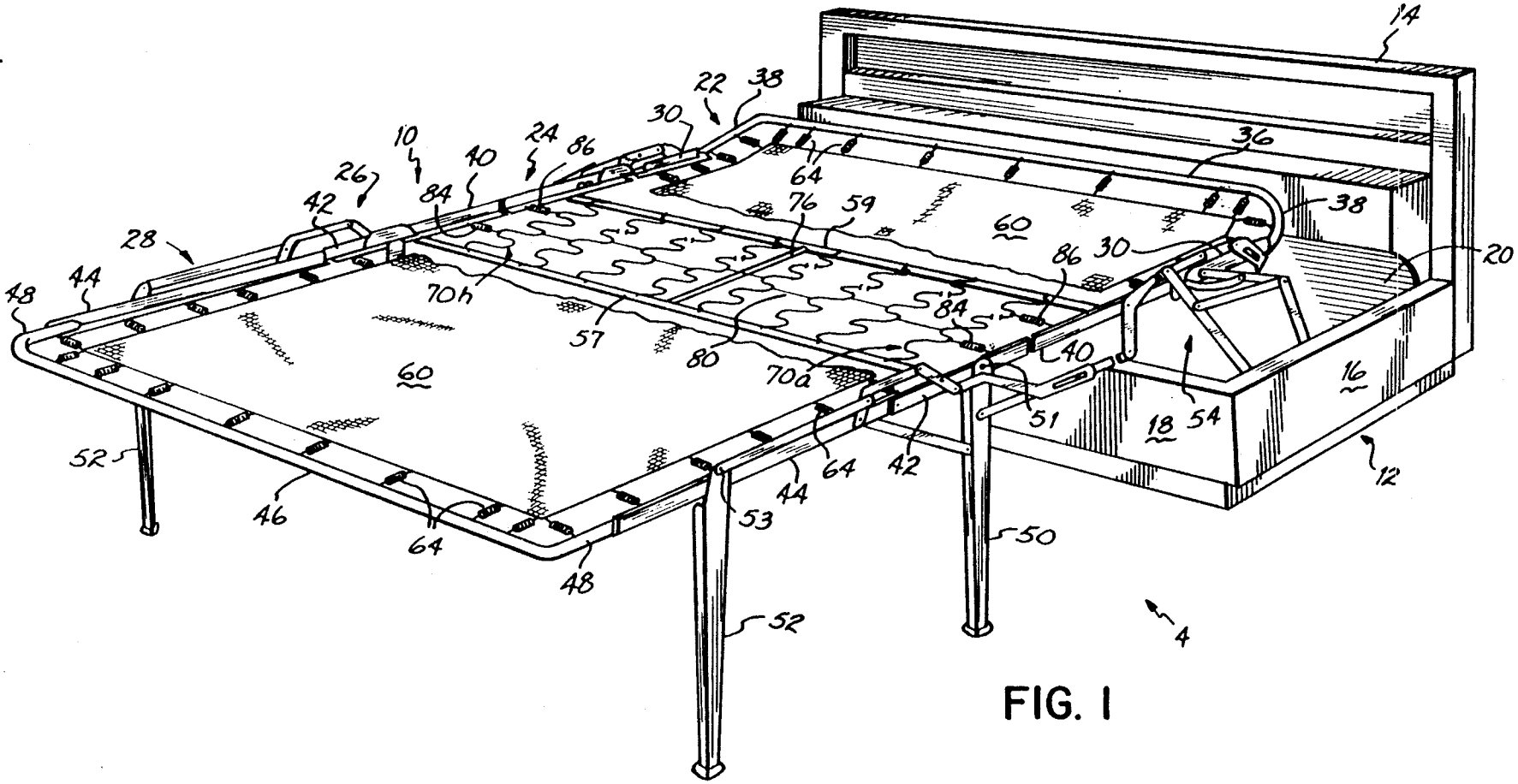
FIG. 1 is a perspective, partially broken away, view of a foldable sofa sleeper embodying the improved mattress support of this invention, the sofa sleeper assembly being shown in the extended bed position.
Figure 2:
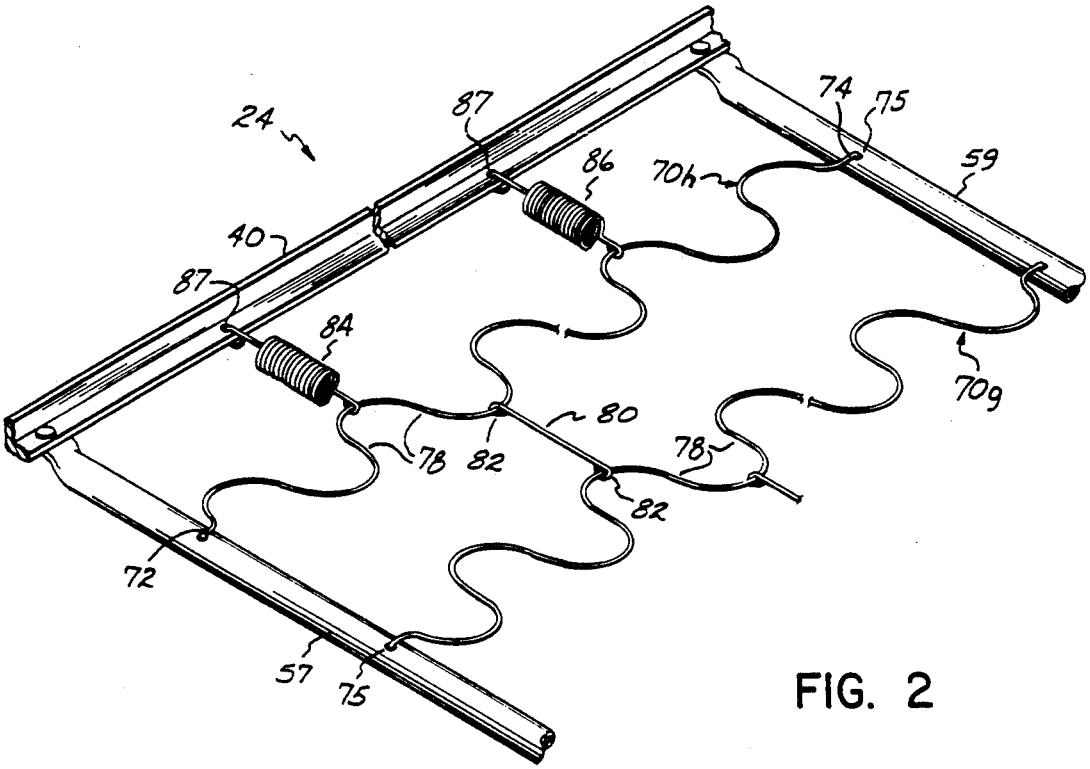
FIG. 2 is a partial cut away view of the connection between the sinuous wire springs and structural elements of the body frame section of the sofa sleeper assembly.

Referring to FIG. 1, the sofa sleeper comprises a sofa sleeper assembly 4 including a foldable sofa sleeper frame 10 mounted upon a wooden sofa frame 12. The wooden frame 12 has a back rest 14, a pair of side rails 16 and a fixed front rail 18, which together define a generally rectangular storage enclosure 20 for the folded sofa sleeper assembly 4. The wooden sofa frame 12 does not form any part of the invention of this application and comprises any well known standard frame. As used herein, the terms "front" or "forward" end of the bed reference that direction which is toward the front end of the unfolded bed, while the terms "rear" or "rearward" refer to a direction which is toward the head end of the unfolded bed or the back rest 14 of the sofa.

The foldable sofa sleeper frame 10 comprises a rear head section 22, a body supporting section 24 pivotally connected at one end to the head section 22, a short intermediate section 26 pivotally connected at one end to the other end of the body section 24, and a front foot section 28 pivotally connected to the other end of the intermediate section 26. The head section 22 comprises similar symmetrically disposed left and right main angles 30 each having an outer vertical flange extending up from an outer end of a lower inwardly extending horizontal flange. The rearward ends of the main angles 30 of head section 22 are interconnected by a cross member 36 which comprises a transverse tubular member bent at its ends to form arms 38 which are riveted to adjacent ends of the main angles 30.

The body section 24, the intermediate section 26, and foot section 28 each comprise similar symmetrically disposed left and right side rails or main angles 40, 42 and 44, respectively. A cross member 46 interconnects the forward ends of the foot section rails or angles 44. The cross member 46, like the cross member 36, comprises a transverse tubular member bent at its ends to form arms 48 which are riveted to adjacent ends of the foot section angles 44. The long angles 40 of the body section 24 serve to guide the folded frame 10 into the sofa enclosure 20, and are sometimes referred to in the art as "pilot section" angles. For purposes of this application, these angles 40 will therefore sometimes be referred to hereinafter as body section main angles 40 or as pilot section angles or side rails members 40.

The interconnected bed frame sections 22, 24, 26 and 28 are supported in their extended position by a pair of foldable center support legs 50 pivotally connected at their upper ends by rivets 51 to the forward ends of the pilot section angles 40, and a pair of foot section supporting legs 52 pivotally connected at their upper end by rivets 53 to the foot section angles 44. A tubular cross member (not shown) preferably interconnects the center legs 50 and is riveted at either end thereto to provide the legs 50 with lateral stability.

Figure 3:
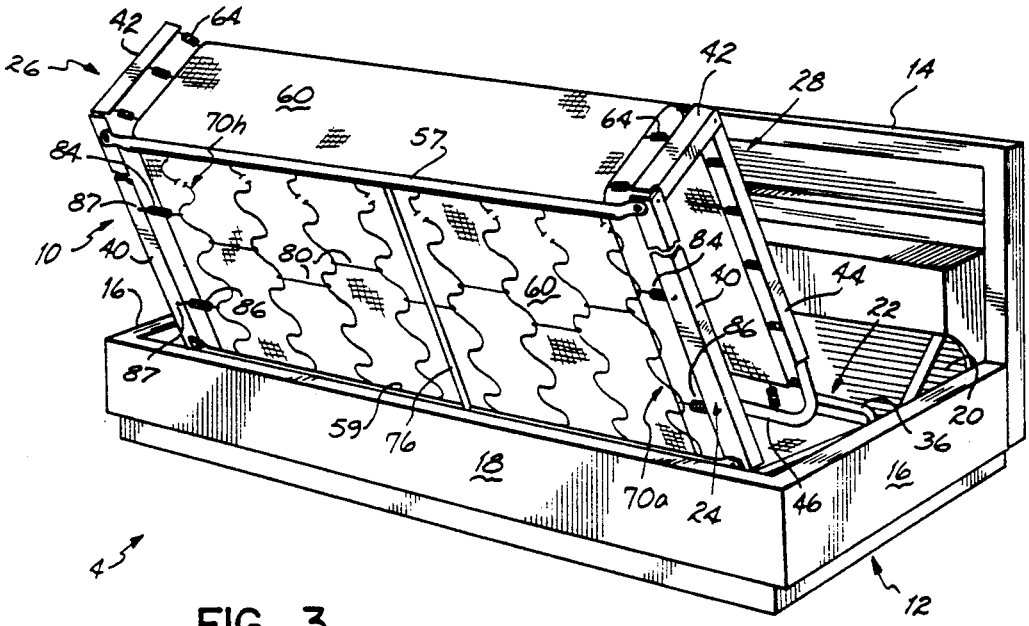
FIG. 3 is a partial perspective view of the foldable sofa sleeper of FIG. 1, with the sleeper being shown in a partially retracted position and a portion of the collapsible linkage structure removed for clarity of the Figure.
Figure 4:
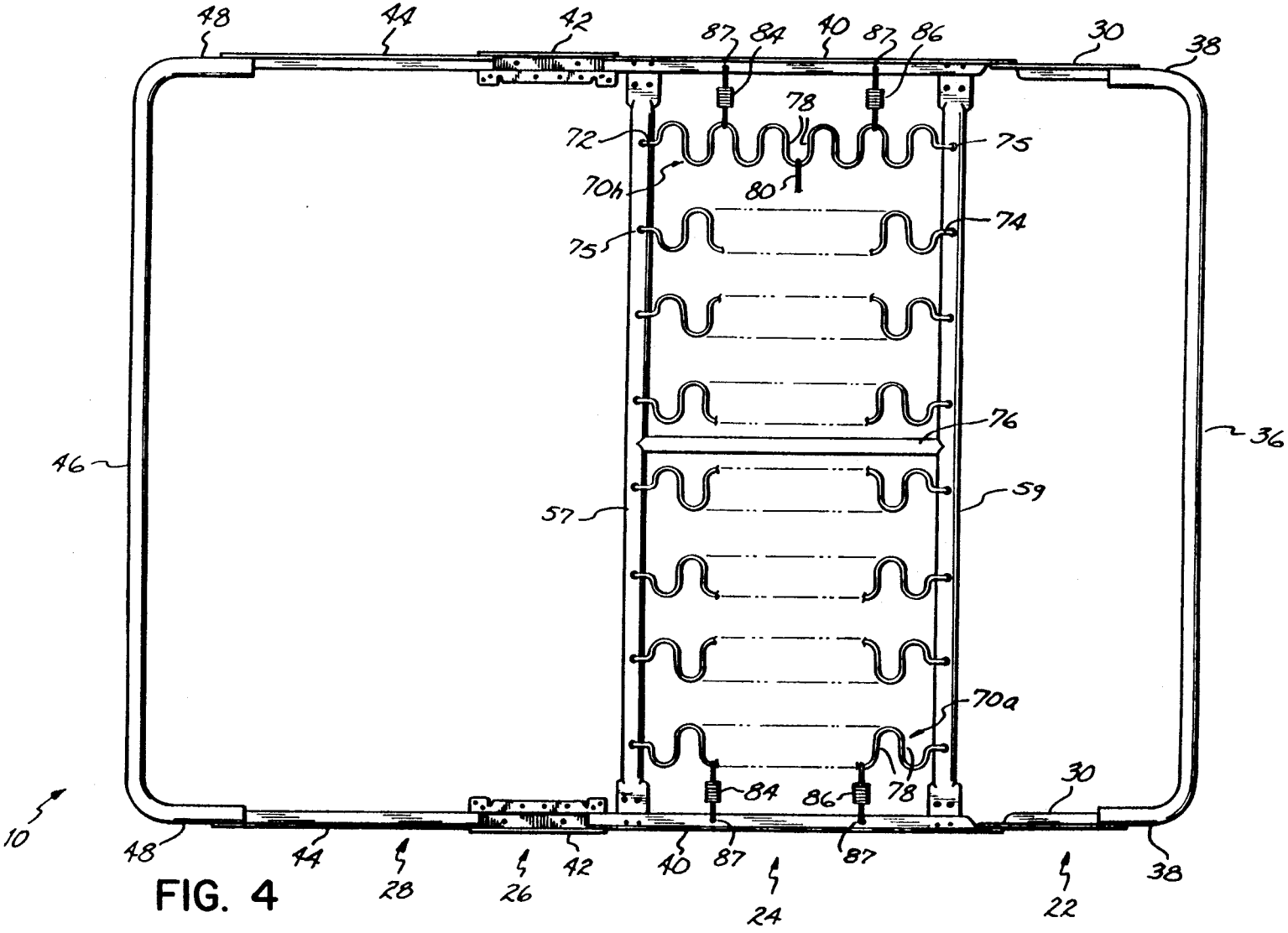
FIG. 4 is a top plan view of the sofa sleeper assembly frame portion of the sofa sleeper of FIG. 1 with the frame in an unfolded bed position.

The side frame angles 30, 40, 42, 44 and the opposed head and foot cross members 36, 46 form a rigid bed frame when extended as shown in FIG. 1, and rigid seating frame when retracted as partially shown in FIG. 3. A continuous section of fabric material 60, or a sheet of woven polypropylene or other similar plastic material, is resiliently connected to the side frame angles of section 22, 24, 26, 28 by coil springs 64 to provide a mattress supporting surface for seating and sleeping.

In order to support the sofa sleeper frame 10 for controlled collapsing movement into the wooden sofa frame 12, there is a linkage system, generally designated by the numeral 54, which extends between and interconnects the wooden sofa frame 12 and the foldable sofa sleeper frame 10. This linkage system per se forms no part of the invention of this application, and therefore has not been described in detail herein. A complete description of one such linkage system suitable for use in the practice of this invention is completely described in the assignee's own U.S. Pat. No. 4,253,205, the disclosure of which is incorporated by reference herein. This linkage system not only controls the folding of the foldable sofa sleeper frame 10 and legs 50, 52 into the storage enclosure 20 of the wooden frame, but also controls the unfolding of that frame 10 and the supporting legs when the sofa is converted from an item of seating furniture, i.e., a sofa, into an item of sleeping furniture, i.e., a bed.

In accordance with the practice of this invention, a pair of opposed cross members or cross ties 57, 59 are spaced along the main body section 24 and riveted at each end to the pilot section angles 40. Each cross member 57, 59 is a tubular member which is mounted in substantially the same horizontal plane as the pilot section angles 40. Extending between the transverse cross ties or cross members 57, 59 in main body section 24, are eight transversely spaced, longitudinal extending sinuous wire springs 70*a–h*. Each end of each sinuous spring 70*a–h* has a hook 72, 74 formed thereon and received within a hole 75 formed in the cross ties 57, 59. Thereby the springs 70*a–h* are attached to and supported from the cross ties 57, 59. Preferably, a rigidity bar 76 extends between the cross ties 57, 59 medially of the length of the ties so as to maintain the spacing of the ties 57, 59 after attachment of the springs 70*a–h* and in the use of the sofa sleeper when one or more persons are supported atop the mattress (not shown) of the sofa sleeper.

The eight sinuous springs are all substantially identical. Each comprises a single length of wire having reversely bent, 180° arcs formed therein over the length of the spring and terminating at its ends in the hooks 72, 74. After formation, each sinuous wire is heat treated so as to give it the requisite spring properties. In one preferred embodiment, each spring is approximately $14\frac{3}{4}$ inches in overall length (hole 75 to hole 75), made from 11 gauge wire and has the 180° bends of the spring approximately $1\frac{1}{4}$ inches in diameter D, there being eleven such arcuate 180° bends in the overall length of the spring and twelve interconnecting straight bars 78.

In accordance with the practice of this invention, and in order to maintain the spacing of the springs as well as distribute loads between them, there is at least one straight length of wire 80 extending between each adjacent pair of sinuous springs and connected at its opposite ends to the sinuous springs by an eye 82 formed in each end of the straight wire 80. Additionally, a pair of helical tension springs 84, 86 extend between each of the edgemost sinuous springs 70*a* and 70*h* and the angles 40 so as to connect those edgemost springs to the angles 40 of the body section 24 of the sofa sleeper frame 10. The helical springs 86 are conventional tension springs, the ends of which have eyes formed thereon, one such eye being connected over the edgemost sinuous spring 70*a* or 70*h*, and the opposite end eye passing through a hole 87 of the angles 40 and being thereby connected to the body section 24 of the frame 10.

The longitudinal extending sinuous springs 70*a–h* and the cross ties 57, 59 between which they extend are disposed immediately beneath the fabric material 60 and provide a firm resilient foundation for the main body section 24 when the sofa sleeper is used either as a bed or seating surface. The interconnected pattern of the springs 70 and connecting straight wires 80 provides a uniform support along the width of main body section 24 between pilot section angles 40 which carries one's weight whether sitting at the ends or the middle of the seating surface or bed. In addition, the springs 70*a–h* and connecting wires 80 as well as the connecting helical springs 84, 86 provide a resilient support more nearly approximating that of a conventional box spring supported mattress of a bed than known means of supporting the fabric material 60.

It should be understood that while eight longitudinally extending springs 70*a–h* are shown in the drawings, additional or fewer springs could be utilized to provide firmer or less firm support. In addition, it is contemplated that the hook connections between the ends of the springs 70*a–h* and the cross ties may be replaced with resilient connections such as helical coil springs. This would provide a foundation support for main body section 24 having increased resiliency and less firmness so as to accommodate those desiring that type of sleeping or seating surface.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teaching of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

Wherefore I claim:

1. A sofa sleeper foldable sofa bed assembly adapted to be mounted upon a stationary sofa frame, said bed assembly having pivotally interconnected head, body, intermediate and foot frame sections each including a pair of opposed side rails, said frame sections being extendable to form a bed and foldable to form a sofa seat, and fabric material attached atop at least said head, body and intermediate frame sections, the improvement comprising:

said body section including a mattress supporting panel for reinforcing said body section beneath said fabric material and extending between the side rails of said body section, said panel comprising a pair of opposed rigid cross tie members extending between said side rails; and a plurality of transversely spaced, longitudinally extending sinuous wire springs extending between said cross tie members of said body frame section parallel to said side rails thereof, one end of each of said sinuous wire springs being mounted to one of said cross tie members.

2. The sofa sleeper foldable bed assembly of claim 1 wherein each end of each of said sinuous wire springs is mounted to one of said cross tie members by a substantially rigid support.

3. The sofa sleeper foldable bed assembly of claim 1 wherein each end of each of said sinuous wire springs is connected directly to one of said cross tie members by a hook formed on the end of said sinuous wire springs passing through a hole in one of said cross tie members.

4. The sofa sleeper foldable sofa bed assembly of claim 1 which further includes straight wires interconnecting adjacent ones of said sinuous wire springs.

5. The sofa sleeper foldable sofa bed assembly of claim wherein edgemost ones of said sinuous wire springs are connected to said body frame sections by helical springs.

6. The sofa sleeper foldable sofa bed assembly of claim 1 which further includes a rigidity bar extending between and connected to said cross tie members.

* * * * *

UNITED STATES PATENT AND TRADEMARK OFFICE

CERTIFICATE OF CORRECTION

PATENT NO. : 5,305,479

DATED : April 26, 1994

INVENTOR(S) : Danny C. Robinson

It is certified that error appears in the above-identified patent and that said Letters Patent is hereby corrected as shown below:

Column 6, line 17, "claim wherein" should read --claim 1 wherein--.

Signed and Sealed this

Fourth Day of October, 1994

*Attest:*

*Attesting Officer*

BRUCE LEHMAN

*Commissioner of Patents and Trademarks*